US006061851A

United States Patent [19]

Crowell

[11] Patent Number: 6,061,851

[45] **Date of Patent: *May 16, 2000**

[54] CONNECTED BED SHEET ASSEMBLY

[76] Inventor: Janet C. Crowell, P.O. Box 740, Pittsburg, Tex. 75686

[ * ] Notice: Under 35 U.S.C. 154(b), the term of this patent shall be extended for 111 days.

[21] Appl. No.: 08/544,299

[22] Filed: Oct. 17, 1995

[51] Int. Cl.[7] ..... A47G 9/00

[52] U.S. Cl. ..... 5/497; 5/482; 5/500

[58] Field of Search ..... 5/482, 495, 496, 5/497, 500

[56] References Cited

U.S. PATENT DOCUMENTS

| | | | |
|---|---|---|---|
| 3,694,832 | 10/1972 | Jamison | 5/497 |
| 3,962,739 | 6/1976 | Crockett | 5/497 |
| 4,161,044 | 7/1979 | Bogle | 5/497 |
| 4,241,466 | 12/1980 | Mendyk | 5/500 |
| 4,384,380 | 5/1983 | Glaha et al. | 5/485 |
| 4,698,865 | 10/1987 | Walker | 5/497 |
| 5,173,976 | 12/1992 | Jubinville | 5/497 |
| 5,177,821 | 1/1993 | Kawtoski | 5/497 |

FOREIGN PATENT DOCUMENTS

| | | | |
|---|---|---|---|
| 2608031 | 6/1988 | France | 5/497 |
| 2219740 | 12/1989 | United Kingdom | 5/497 |
| 2273870 | 7/1994 | United Kingdom | 5/497 |

*Primary Examiner*—Terry Lee Melius
*Assistant Examiner*—Robert G. Santos
*Attorney, Agent, or Firm*—Ronald B. Sefrna

[57] ABSTRACT

A connected bed sheet assembly has a fitted bottom sheet and a top sheet aligned with and interconnected to the bottom sheet along a single aligned end and along a single aligned edge, leaving one free end and one free edge. The fitted bottom sheet is formed to fully cover the upper surface of a mattress and extend over the sides and partially underneath the mattress to removably secure the assembly to the mattress. Elastic members are connected to a portion of the ends and edges of the bottom sheet for secure retention to the mattress. The top sheet extends over the bottom sheet from the interconnected end and edge and over the upper surface of the mattress with its free end adjacent to the head of the mattress and its free edge draping over the edge of the mattress.

19 Claims, 7 Drawing Sheets

CONNECTED BED SHEET ASSEMBLY

FIELD OF THE INVENTION

The present invention generally relates to beds and bedding, and in its preferred embodiments more specifically relates to a bed sheet assembly with partially connected top and bottom sheets.

BACKGROUND OF THE INVENTION

Bed covering designs and arrangements in common use have remained largely unchanged for many years, and generally involve the use of a bottom sheet to cover the mattress, a top sheet to cover a sleeper lying on the bottom sheet, and additional blankets or coverings placed above the top sheet when needed or desired. Fitted bottom sheets, with a pocket at each corner to fit around and under the mattress, have been known for some time and have become the conventional design because they are easily installed and removed, and because they stay in place much more reliably than flat sheets. In the conventional approach, however, separate flat top sheet have continued to be the norm, despite disadvantages and problems with their use. Those disadvantages and problems include difficulty in properly aligning the top sheet on the mattress; difficulty in tucking the ends and edges of the top sheet under the mattress, especially when the bed is placed with one side against a wall or access to one side is otherwise obstructed; and difficulty in maintaining the position and attachment of the top sheet during use.

Particular problems exist with bed designs in which one side of the mattress is obstructed, such as with bunk beds which often include a rail on one side to help prevent a sleeper from falling out of the bunk. Beds are also often placed with one side directly against a wall to, for example, maximize floor space in children's rooms, dormitory rooms, apartment bedrooms, cabins, and the like. In those instances access to the obstructed side can be gained only by moving the bed, if possible, by climbing onto the bed, or by reaching over the bed from the unobstructed side.

PRIOR ART

Various attempts have been made to address disadvantages and problems associated with conventional bed sheet designs, with varying degrees of success. None of the approaches known in the prior art have, however, fully addressed the prevalent disadvantages and problems, especially those most directly associated with placing and maintaining sheets on a bed when one side is obstructed or difficult to reach.

In one prior art approach, illustrated by U.S. Pat. No. 4,615,061 to Scott, a fitted bottom sheet and a top sheet are connected at the foot ends, with both side edges of the top sheet remaining free from connection to the bottom sheet. This approach does substantially eliminate problems with the top sheet pulling out from under the foot end of the mattress during use, but does not address the difficulty in dealing with limited access to one side of the bed, and does not restrict lateral displacement of the top sheet other than at the foot end of the bed.

U.S. Pat. No. 5,084,929 to Staudinger illustrates an approach in which top and bottom sheets are connected not only at the foot, but also along a substantial portion of both edges along the upper edge of the mattress. The top sheet is releasably connected to the bottom sheet along an additional portion of their edges toward the head of the bed, and an elastic strap is provided to extend across the width of the bed near the head to hold down the top sheet. The Staudinger design is disclosed for use primarily with small children to provide a snug enclosure as well as to control movement of the top sheet.

U.S. Pat. No. 4,402,098 to McClam discloses a bed covering with a fully fitted side portion, which does not fully cover the mattress, and a top portion equivalent to a top sheet that is connected to the fitted portion along the full length of both edges. The top covering has an extended skirt that allows the top portion to be raised above the mattress to accommodate a sleeper. Those designs with sheets fully or substantially connected at their edges have a significant disadvantage in that the always cover a sleeper even if the sleeper wishes to remove all or part of the covering.

In another approach, illustrated by U.S. Pat. No. 4,771,496 to Cash, et al., the top and bottom sheets are connected along their longitudinal center line from their foot ends through a substantial portion of the length of the bed, to provide a pair of separated compartments. The edges of the top sheet are completely free of the bottom sheet and hang over the side of the bed in the conventional manner. While effective for the intended use of separating two sleepers and limiting contact between them, the Cash et al. approach does not attempt to address problems associated with limited access to one side of the bed.

Other sheet designs are known in prior art, such as sheets designed specifically for use with waterbed mattresses, but all known prior art designs treat both sides of the bed symmetrically and none, therefore, address the problems or needs associated with beds in which access to one side is limited due to bed design and/or placement.

There remains a substantial and unfilled need for a connected bed sheet assembly that not only addresses the problems associated with conventional separated sheet systems, but that also addresses the disadvantages of and the problems remaining with the prior art designs for connected bed sheet systems.

SUMMARY OF THE INVENTION

The present invention provides a connected bed sheet assembly that addresses the common problems associated with completely separate bottom and top sheets, and that also addresses the particular problems associated with beds in which access to one side is limited, such as bunk beds or beds placed with one side against a wall.

The connected bed sheet assembly of the invention includes a fully fitted bottom sheet, formed with pockets at each of the four corners to facilitate the secure but readily removable attachment of the assembly to a mattress, and a top sheet connected to the bottom sheet at their respective foot ends and along one side edge through the majority of the length of the mattress. The top sheet is asymmetrically positioned relative to the bottom sheet, and thus to the mattress when in place, with one edge coincident with the edge of the bottom sheet to which it is connected, and the other edge free from and extending outwardly from the edge of the bottom sheet.

With the top sheet connected to the bottom sheet at the foot and long one edge the connected sheet assembly can be easily placed on and connected to the mattress by placing the fitted pockets over and underneath the mattress corners as with a conventional fitted sheet. Because the top and bottom sheets are connected along one edge, that edge of the top sheet is automatically placed in the proper position relative to the mattress when the fitted corners of the assembly are positioned on the mattress, and the connected edge requires no further attention or manipulation. The free edge of the top sheet will fall readily into place when simply pulled across the mattress and will lie smoothly over the bottom sheet in proper position. The only step required to place the bottom and top sheet assembly of the invention on a bed in addition to the steps required for placement of a conventional fitted bottom sheet is the step of pulling the free edge of the top sheet across the top sheet so that it will hang freely over the associated side of the bed. Since the connected edges of the bottom and top sheets are automatically positioned when the fitted pockets are placed over the mattress corners, no access to the side of the bed associated with those connected edges is required, and the manipulations required to properly position and attach a conventional top sheet are eliminated.

Although one edge of the top sheet is attached to the bottom sheep, the sheet assembly of the invention does not interfere with the ability of a sleeper to adjust the position of the top sheet to control the degree of coverage provided, from fully covered to fully uncovered. Since the top sheet is free from the bottom sheet at the head and along the full length of one side the top sheet does not constrict or restrain the position or freedom of movement of a person using the bed, and may thus be used with complete comfort but without the disadvantages of conventional separate sheets or of connected sheet designs known in the prior art.

The structure and features of the preferred embodiment of the connected bed sheet assembly of the invention will be described in more detail with reference to the accompanying drawing figures.

DETAILED DESCRIPTION OF THE INVENTION

Figure 1:
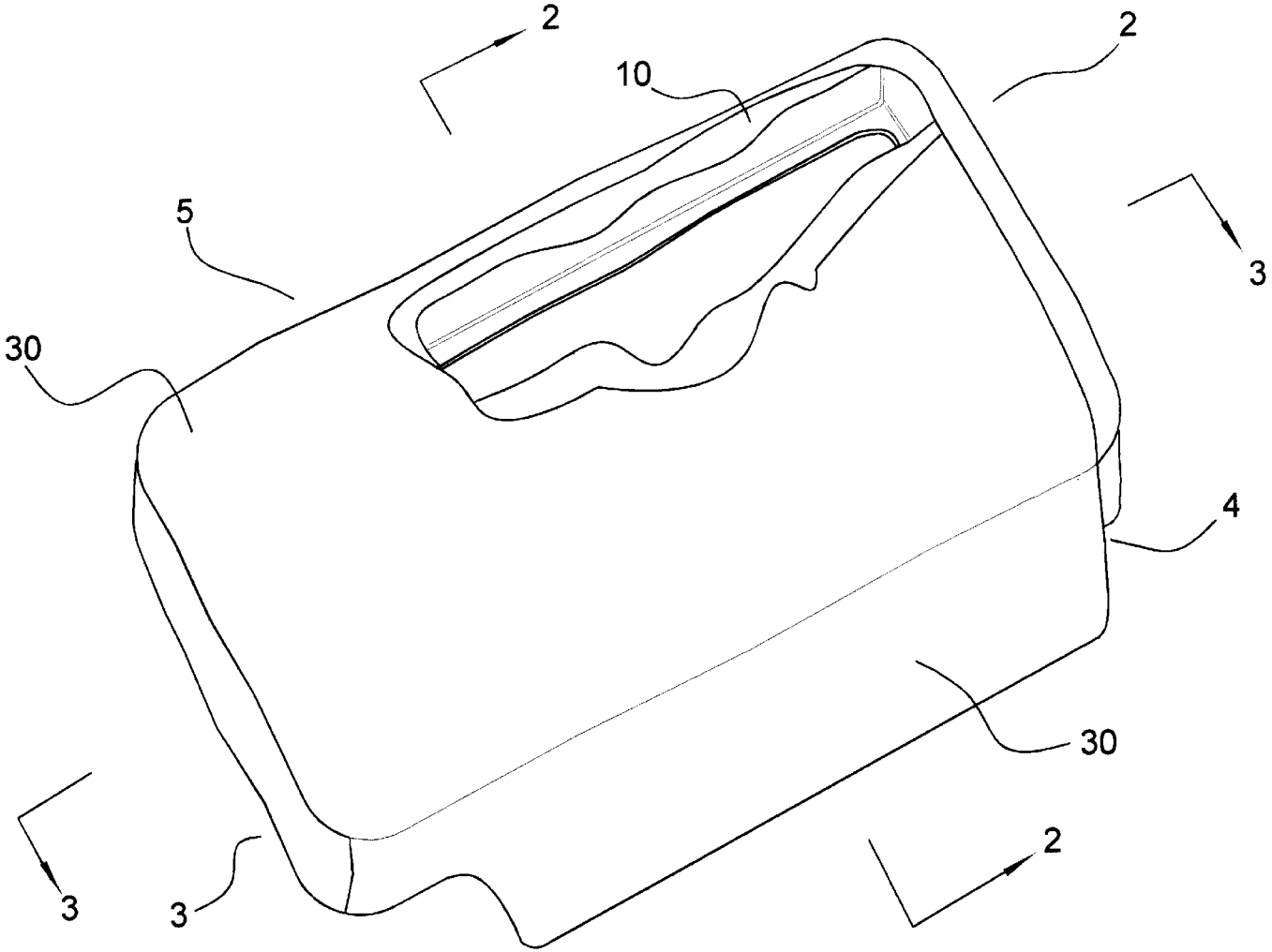
FIG. 1 is a partially cut-away perspective view showing the preferred embodiment of the connected bed sheet assembly of the invention in place on a mattress.
Figure 2:
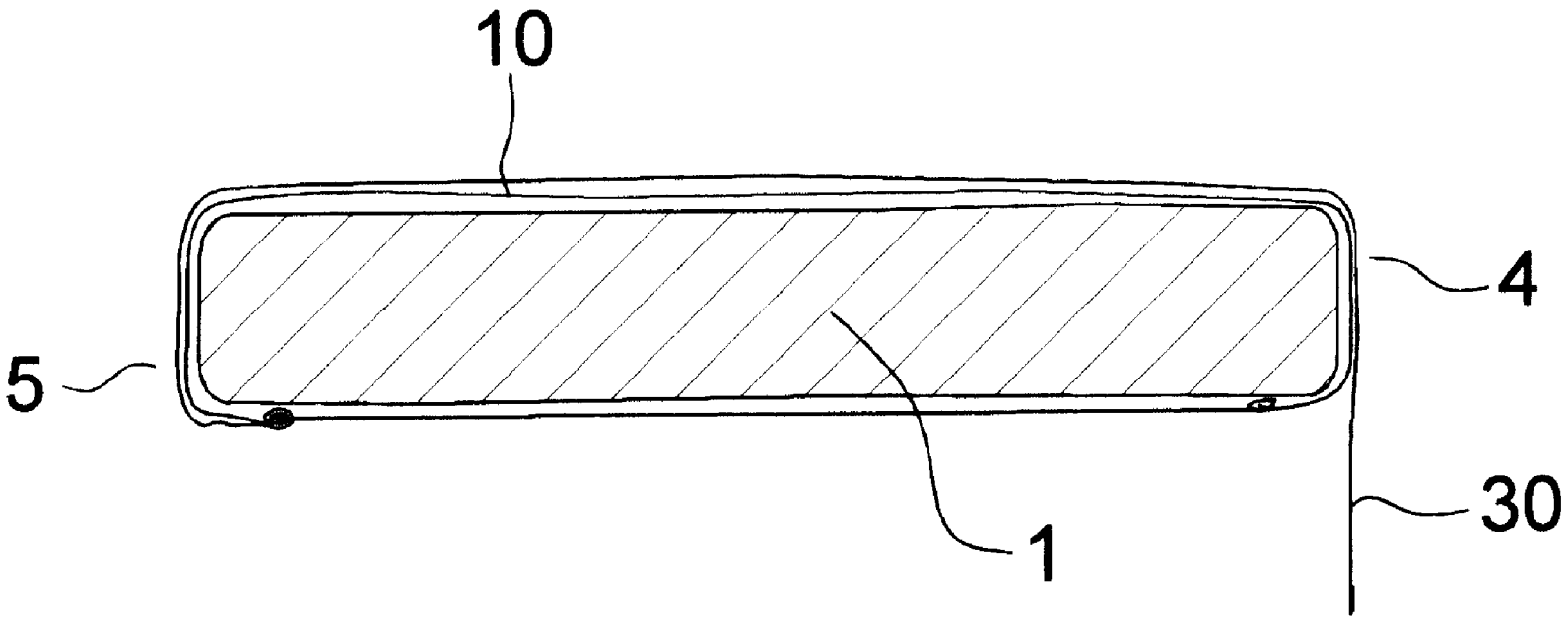
FIG. 2 is a sectioned end view of the preferred embodiment of the invention in place on a mattress, from the foot of the mattress along line 2—2 of FIG. 1.
Figure 3:
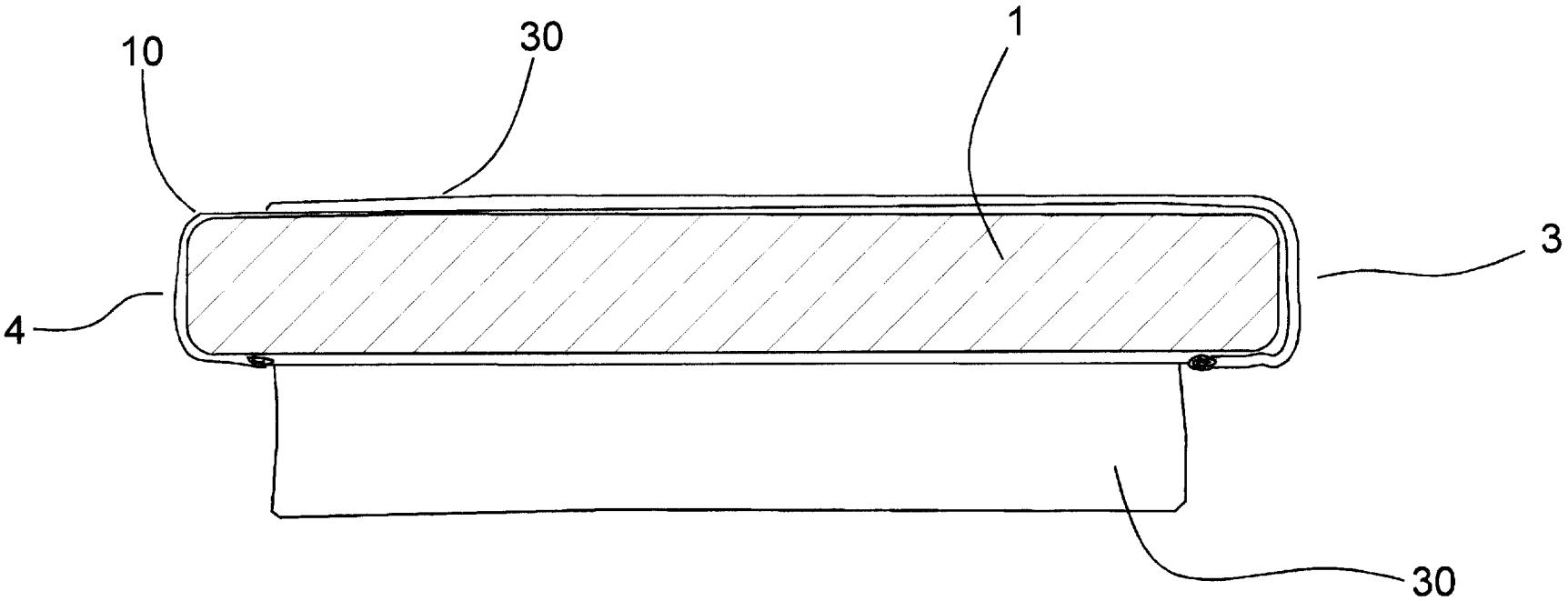
FIG. 3 is a sectioned side view of the preferred embodiment of the invention in place on a mattress, from one side of the mattress, along line 3—3 of FIG. 1.

With reference to the accompanying drawing figures, the connected bed sheet assembly of the invention generally comprises the basic components of a bottom sheet 10 and a top sheet 30, adapted for use in covering and preparing a mattress, 1, for use as a bed. In the drawing figures and in the following description, the mattress is oriented with a head end 2, a foot end 3, a first side 4, and a second side 5.

Figure 4A:
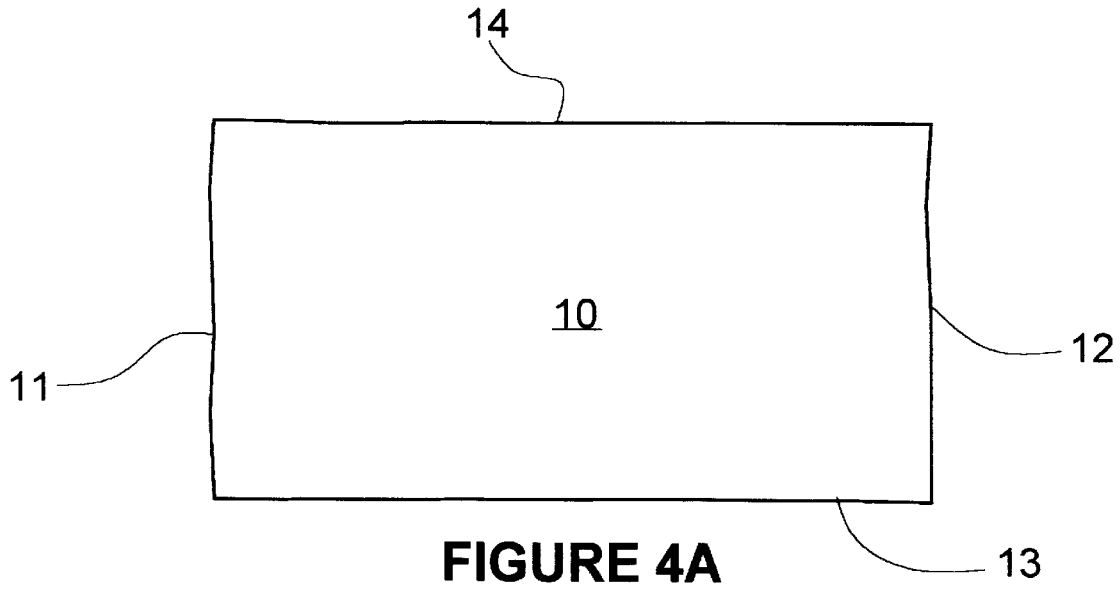
FIG. 4A is a top plan view of a sheet of material for forming the bottom sheet component of the preferred embodiment of the bed sheet assembly of the invention.
Figure 4B:
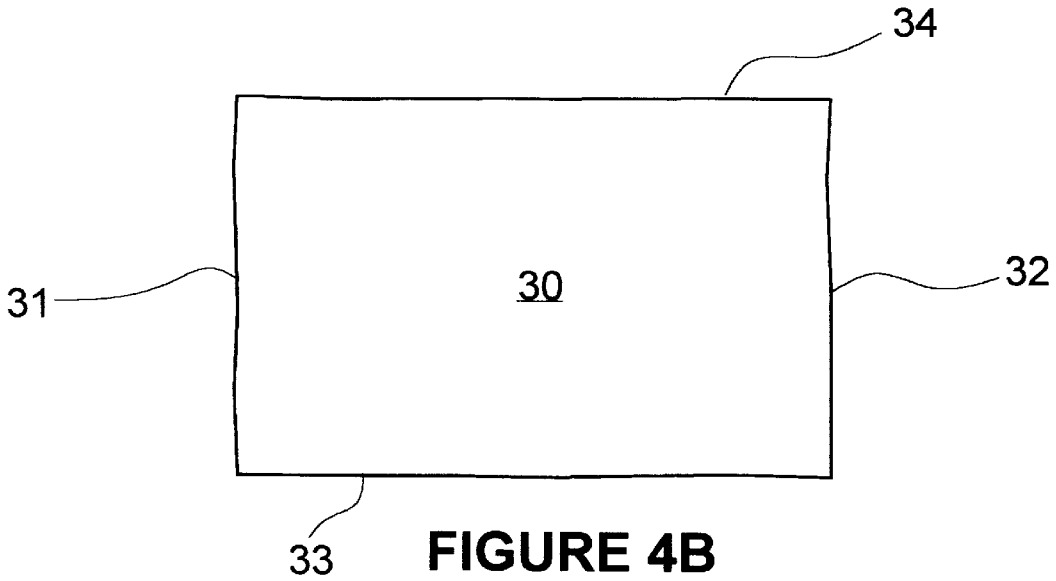
FIG. 4B is a top plan view of a sheet of material for forming the top sheet component of the preferred embodiment of the bed sheet assembly of the invention.
Figure 5A:
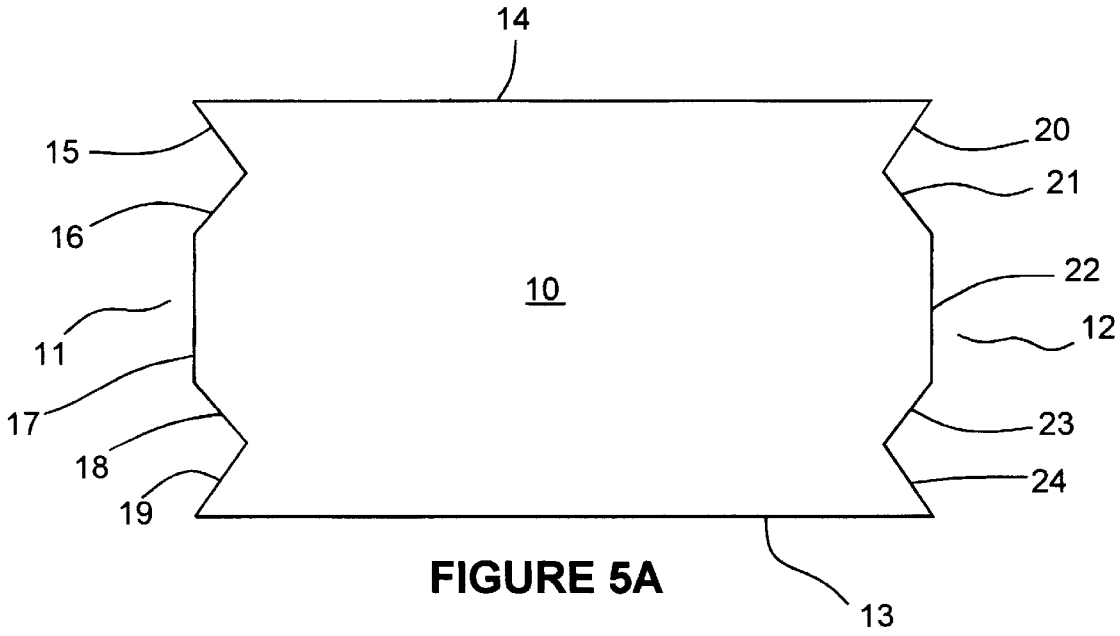
FIG. 5A is a top plan view of the sheet of material for forming the bottom sheet component, as in FIG. 4A, prepared for joining with the top sheet component.
Figure 5B:
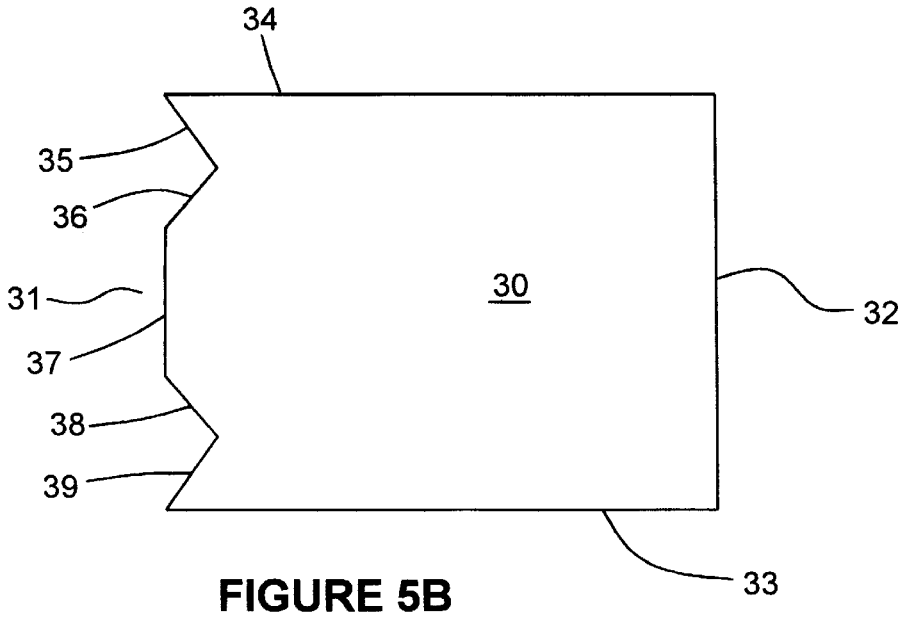
FIG. 5B is a top plan view of the sheet of material for forming the top sheet component, as in FIG. 4B, prepared for joining with the bottom sheet component.

Bottom sheet component 10 is typically, and preferably, formed from a rectangular piece of material, as shown in FIG. 4A, having a foot end 11, a head end 12, a first edge 13, and a second edge 15. Similarly, top sheet component 30 is typically and preferably formed from a rectangular piece of material of the same width but with greater length than the material used to form the bottom sheet component, as illustrated in FIG. 4B. Top sheet component has a foot end 31, a head end 32, a first side 33, and a second side 34. In the preferred method of construction of the assembly of the invention, notches or darts are cut in both ends 11 and 12 of the bottom sheet component, and in foot end 31 of the top sheet component, as shown in FIGS. 5A and 5B, respectively. The cutting of the darts in the bottom sheet component creates seam edges 15, 16, 17, 18, and 19 at foot end 11; and seam edges 20, 21, 22, 23, and 24 at head end 12. With the top sheet component seam edges 35, 36, 37, 38, and 39 are formed at foot end 31, but head end 32 is left undisturbed, without darts.

The assembly of the invention is constructed by placing top sheet component 30 on bottom sheet component 10 and positioning the top and bottom sheet components with their foot and side edges in alignment. A seam is formed joining edges 15 and 35, 16 and 36, 17 and 37, 18 and 38, 19 and 39; joining edges 14 and 34; and joining edges 13 and 33 through a minor portion of the length of edge 33. In the preferred embodiment up to about ten percent of the length of edge 33 is joined to edge 13 to facilitate the formation of a fitted pocket, but it will be understood that edge 33 may be free without any connection to edge 13 if desired. Although it is preferred that edges 14 and 34 be joined through the full length of edge 34, a minor portion of edge 34 adjacent to end 32 may be left free of connection to edge 14, if desired, to allow some additional flexibility in the arrangement of top sheet 30. A seam is also formed joining combined edges 15-35 to 16-36, and 18-38 to 19-39 to form pockets at the foot of the sheet assembly for placement around under the respective mattress corners. In addition, in bottom sheet component 10, edge 20 is joined to edge 21, and edge 23 is joined to edge 24 to form mattress pockets in the head end of the bottom sheet. As noted above, head end 32 of the top sheet component, as well as the majority of edge 33, are free of connection to the bottom sheet component, with the connected edges extending along slightly more than half the perimeter of the bottom sheet component.

Figure 6:
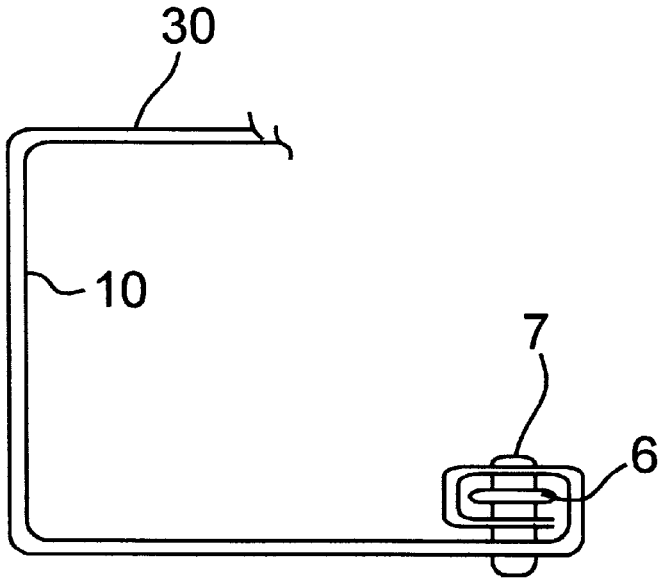
FIG. 6 is a sectioned detail view showing the joining of the bottom sheet component to the top sheet component of the preferred embodiment of the invention.

It is preferred that an elastic band or cord be placed in the seams formed to connect at least the foot ends of the bottom and top sheet components and the seam forming the pockets at the head end of the bottom sheet component, for the purpose of retaining the resulting fitted pockets on a mattress. In the preferred embodiment, an elastic member, e.g., a band or cord, extends from each foot pocket and along the adjacent edge to the associated head pocket at the opposite end of the assembly, with the elastic band secured by a seam formed in the unconnected edges of the bottom sheet as well as by the seams joining the two sheet components. FIG. 6 is a detail view illustrating a seam joining the two sheet components and securing an elastic band, 6, as described. In FIG. 6 stitches preferably used to form the seam as illustrated by numeral 7, although it will be understood that conventional joining means other than stitches may be used to form the seams if desired. The formation of fitted sheet pockets in a single bottom sheet is well known in the art, and elastic is used to varying degrees as a matter of design choice. It will be understood that various techniques may be used to form the fitted pockets of the connected bed sheet assembly of the invention, and that varying degrees of elasticity may be employed within the scope of the invention, so long as adequate fit and retention of the sheet assembly on a mattress is reasonably assured.

The connected bed sheet assembly of the invention is placed on a mattress and prepared for use by positioning the aligned bottom and top sheets on a mattress, placing the two combined foot end pockets around and under the corners of the mattress at the foot end, and placing the two bottom sheet pockets around and under the corners of the mattress at the head end. The sequence of pocket placement is not critical or significant to the use of the sheet assembly, and it will be understood that placement of the pockets may be done in the same manner used to place a single fitted bottom sheet, allowing a user to employ any approach and sequence with which he or she is familiar. With the pockets in place on the mattress, completion of the sheet assembly placement involves the single additional step of pulling the top sheet component across the mattress to lie smoothly over the bottom sheet component. The connected bed sheet assembly of the invention thus eliminates the several additional steps of placing a separate top sheet on a mattress after placement of a fitted bottom sheet, allows a bed to be prepared in a shorter time, and completely eliminates any need to manipulate the connected side of the sheet assembly.

Figure 7:
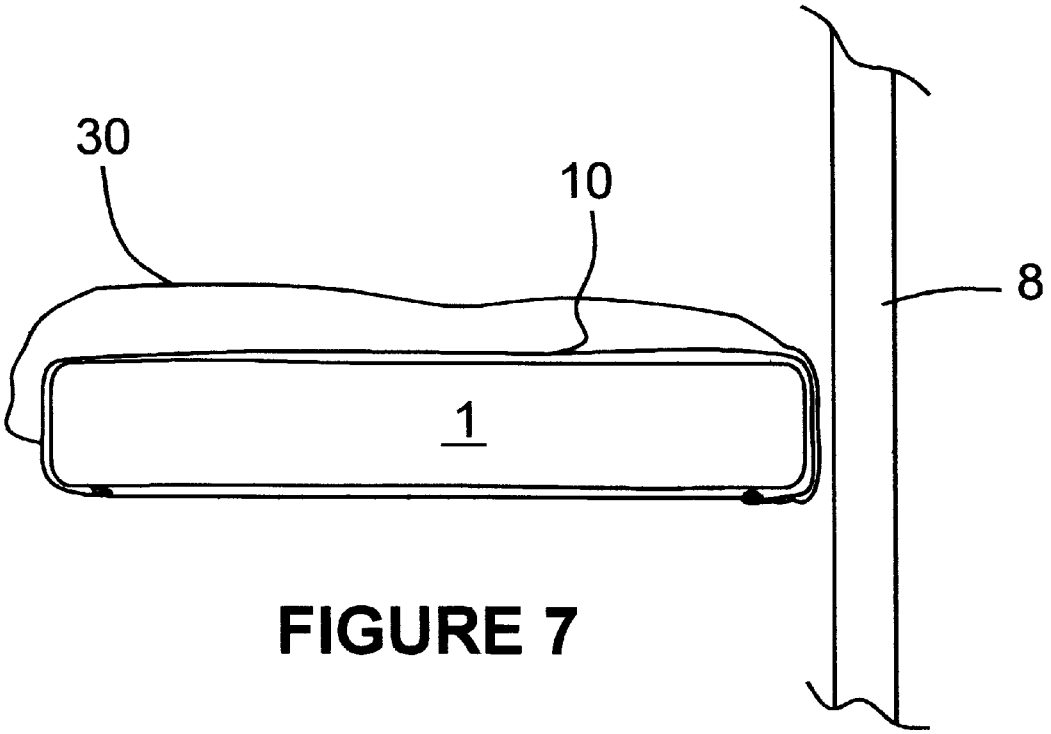
FIG. 7 is an end view of the preferred embodiment of the invention in place on a mattress adjacent to a wall, from the head end of the mattress, illustrating the unrestricted nature of the top sheet component placement.

The elimination of any need for one preparing a bed to work on the side of the mattress associated with the connected edges greatly facilitates the preparation of a bed placed with that edge along a wall, or in any other arrangement in which access to that side is restricted. Accordingly, the bed sheet assembly of the invention is particularly well suited for use with dormitory beds, bunk beds, youth beds, and the like, which are commonly placed against a wall or are otherwise obstructed on one side. FIG. 7 shows the sheet assembly of the invention in place on a mattress placed against a wall, designated by reference numeral 8.

A person desiring to use a bed prepared with the sheet assembly of the invention may simply lift the head and free side edge of the top sheet, lie upon the bottom sheet, and pull the top sheet over himself or herself to the extent desired. The top sheet offers essentially no restriction to movement, and may be placed in a wide variety of positions on the bed, to accommodate the degree of coverage desired.

Figure 8:
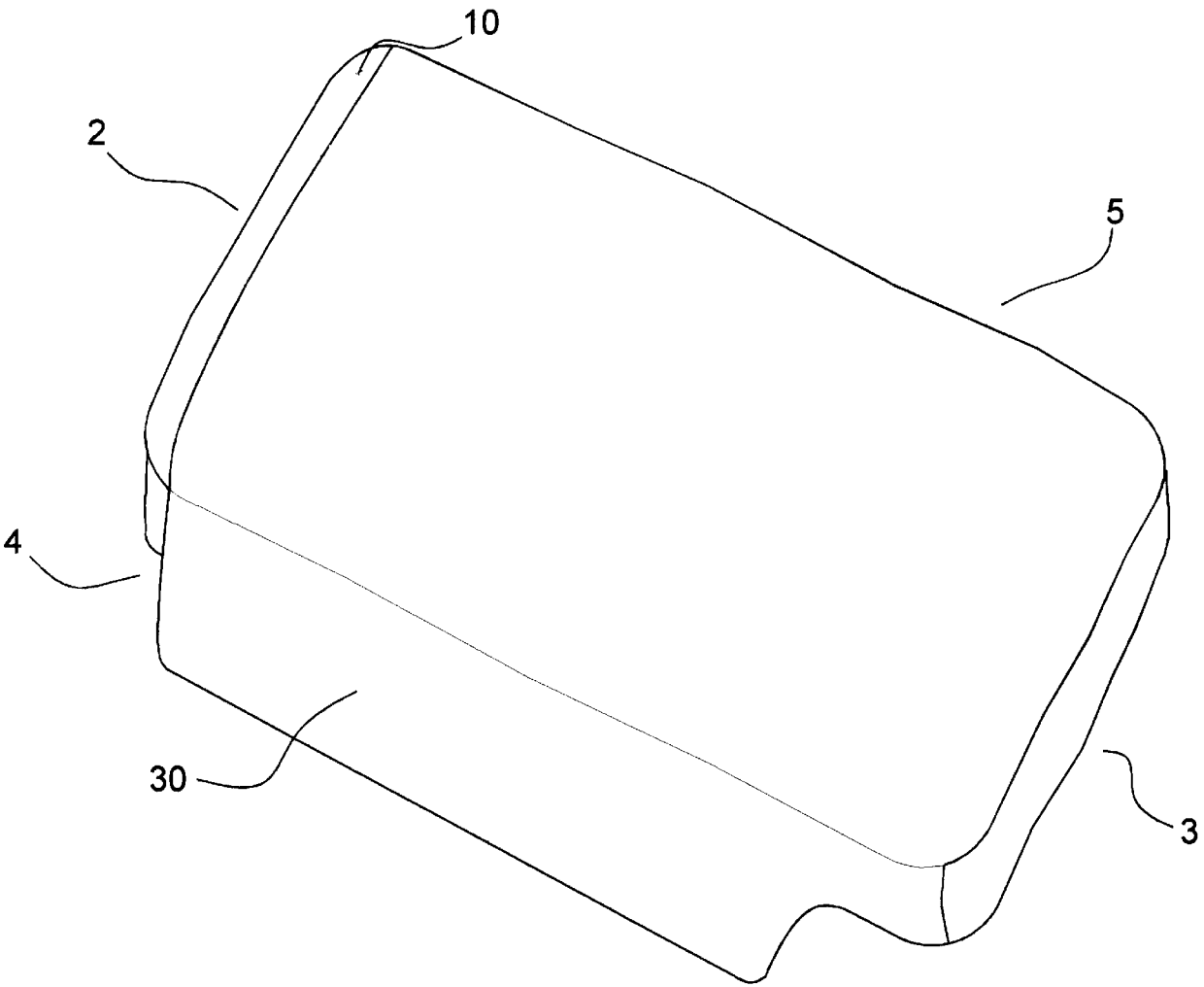
FIG. 8 is a perspective view showing a reversed orientation embodiment of the connected bed sheet assembly of the invention in place on a mattress.

It will be understood from the description and from the drawing figures referred to above, that the connected bed sheet assembly of the invention may be provided in "left" and "right" orientations to allow a user to select the side of the bed desired for entry and the end of the bed the user wishes to select as the head. FIG. 8 illustrates an orientation opposite that shown in FIG. 1, as a mirror image of the FIG. 1 orientation. A single orientation may be used regardless of which side of a bed is obstructed, so long as the user is not concerned with selecting a particular end of the bed at which to place his or her head. It will also be understood that the bed sheet assembly of the invention is readily useable with a free standing bed and is not limited to use in situations in which the bed is placed against a wall or is otherwise obstructed. When used with a free standing bed the bed sheet assembly substantially reduces the possibility that the top sheet will become twisted or bunched, or otherwise disarrayed, and makes facilitates "repair" of a disarrayed bed.

The foregoing description of the preferred embodiments of the invention is illustrative and not for purposes of limitation. The invention is susceptible to various modifications and alternative embodiments, all within the scope of the invention as claimed.

What is claimed is:

1. A connected bed sheet assembly comprising a bottom sheet having a first end and a second end with said first end and said second end in opposed generally parallel relation, and having a first edge and a second edge with said first edge and said second edge in opposed generally parallel relation; and a top sheet having a first end and a second end with said first end and said second end in opposed generally parallel relation, and having a first edge and a second edge with said first edge and said second edge in opposed generally parallel relation, with said first end of said top sheet connected to said first end of said bottom sheet, with said first edge of said top sheet connected to said first edge of said bottom sheet along a substantial majority of the length of said first edges, with said second end of said top sheet free from connection to said second end of said bottom sheet, and with said second edge of said top sheet free from connection to said second edge of said bottom sheet through a substantial majority of the length of said second edges.

2. The connected bed sheet assembly of claim 1, wherein said bottom sheet comprises a fitted sheet.

3. The connected bed sheet assembly of claim 1, wherein said assembly is adapted to be removably secured to a mattress having a first corner, a second corner, a third corner, and fourth corner, and wherein said assembly further comprises a first pocket formed at the intersection of said connected first ends of said bottom sheet and said top sheet with said connected first edges of said bottom sheet and said top sheet, said first pocket to be received over said first corner of said mattress;

a second pocket formed at the intersection of said connected first ends of said bottom sheet and said top sheet with said second edge of said bottom sheet and said second edge of said top sheet, said second pocket to be received over said second corner of said mattress;

a third pocket formed at the intersection of said first edge of said bottom sheet with said second end of said bottom sheet, said third pocket to be received over said third corner of said mattress; and a fourth pocket formed at the intersection of said second end of said bottom sheet with said second edge of said bottom sheet, said fourth pocket to be received over said fourth corner of said mattress.

4. The connected bed sheet assembly of claim 3, wherein said mattress has a top, and wherein said connected first ends of said bottom sheet and said top sheet are to be received under said mattress, said connected first edges of said bottom sheet and said top sheet are to be received under said mattress, said second end of said bottom sheet is to be received under said mattress, said second edge of said bottom sheet is to be received under said mattress, and further wherein said second end of said top sheet lies freely across said top of said mattress and said second edge of said top sheet extends freely downwardly from said top of said mattress with said assembly removably secured to said mattress.

5. The connected bed sheet assembly of claim 1, wherein said second edge of said top sheet is connected to said second edge of said bottom sheet through a minor portion of said second edges extending from said connected first ends of said top sheet and said bottom sheet toward said second ends of said top sheet and said bottom sheet.

6. The connected bed sheet assembly of claim 3, wherein each of said pockets is formed with an elastic member to facilitate retention of said pocket over the respective of said corners of said mattress.

7. The connected bed sheet assembly of claim 1, further comprising a first elastic member extending along and connected to said connected first edges of said top sheet and said bottom sheet, extending along and connected to a portion of said connected first ends of said top sheet and said bottom sheet adjacent to said connected first edges, and extending along and connected to a portion of said second end of said bottom sheet adjacent to said connected first edges; and a second elastic member extending along and connected to said second edge of said bottom sheet, extending along and connected to a portion of said connected first ends of said top sheet and said bottom sheet adjacent to said second edge of said bottom sheet, and extending along and connected to a portion of said second end of said bottom sheet adjacent to said second edge of said bottom sheet.

8. The connected bed sheet assembly of claim 1, wherein said bottom sheet and said top sheet are formed of flexible woven fabric.

9. A connected bed sheet assembly for covering a mattress, the mattress having an upper surface, a lower surface with a peripheral edge, a first corner, a second corner, a third corner, and a fourth corner, the connected bed sheet assembly comprising a fitted bottom sheet to be removably secured over said mattress, having a first end and a second end with said first end and said second end in opposed generally parallel relation, having a first edge and a second edge extending between said first and second ends with said first edge and said second edge in opposed generally parallel relation, having a first pocket at the intersection of said first end and said first edge, a second pocket at the intersection of said first end and said second edge, a third pocket at the intersection of said second end and said first edge, and a fourth pocket at the intersection of said second end and said second edge, each of said pockets to be received over the respective one of said corners of said mattress with said first end, said first edge, said second end, and said second edge of said bottom sheet underlying said lower surface of said mattress adjacent to said peripheral edge thereof; and a top sheet having a first end and a second end with said first end and said second end in opposed generally parallel relation, having a first edge and a second edge with said first edge and said second edge in opposed generally parallel relation, with said first end of said top sheet connected to said first end of said bottom sheet, with said first edge of said top sheet connected to said first edge of said bottom sheet along a substantial majority of the length of said first edges, with said second end of said top sheet free from connection to said second end of said bottom sheet, and with said second edge of said top sheet free from connection to said second edge of said bottom sheet, said top sheet having a fifth pocket at the intersection of said first end and said first edge, aligned with said first pocket of said bottom sheet, and having a sixth pocket at the intersection of said first end and said second edge, aligned with said second pocket of said bottom sheet, said fifth and sixth pockets to be received over corners of said mattress with said first and second pockets of said bottom sheet, with said first end and said first edge of said top sheet underlying said lower surface of said mattress adjacent to said peripheral edge thereof in alignment with said first end and said first edge of said bottom sheet.

10. The connected bed sheet assembly of claim 9, wherein said fifth pocket is interconnected to said first pocket, and wherein said sixth pocket is interconnected to said second pocket.

11. The connected bed sheet assembly of claim 10, further comprising a first elastic member extending along and interconnected to said connected first edges of said bottom sheet and said top sheet from said interconnected first and fifth pockets to said third pocket; and a second elastic member extending along and interconnected to said second edge of said bottom sheet from said interconnected second and sixth pockets to said fourth pocket.

12. The connected bed sheet assembly of claim 11, wherein said first elastic member extends along a portion of the length of said connected first ends of said bottom sheet and said top sheet from said interconnected first and fifth pockets toward said interconnected second and sixth pockets and along a portion of the length of said second end of said bottom sheet from said third pocket toward said fourth pocket, and wherein said second elastic member extends along a portion of the length of said connected first ends of said bottom sheet and said top sheet from said interconnected second and sixth pockets toward said interconnected first and fifth pockets and along a portion of the length of said second end of said bottom sheet from said fourth pocket toward said third pocket.

13. The connected bed sheet assembly of claim 9, wherein said fifth pocket is unitary with said first pocket, and wherein said sixth pocket is unitary with said second pocket.

14. A connected bed sheet assembly for covering a mattress, the mattress having a first end and a second end, a first edge and a second edge, an upper surface and a lower surface, comprising a fully fitted bottom sheet having a first end, a second end, a first edge and a second edge, to be received over said mattress so as to fully cover said upper surface thereof, with said first end extending over said first end of said mattress and over said lower surface of said mattress a short distance from said first end of said mattress, with said second end extending over said second end of said mattress and over said lower surface of said mattress a short distance from said second end of said mattress, with said first edge extending over said first edge of said mattress and over said lower surface of said mattress a short distance from said first edge of said mattress, and with said second edge extending over said second edge of said mattress and over said lower surface of said mattress a short distance from said second edge of said mattress; and a partially fitted top sheet having a first end, a second end, a first edge, and a second edge, said first end of said top sheet interconnected to said first end of said bottom sheet and extending over said first end of and along said lower surface of said mattress with said first end of said bottom sheet, said first edge of said top sheet interconnected to said first edge of said bottom sheet through substantially the full length of said first edges and extending over said first edge of and along said lower surface of said mattress with said first edge of said bottom sheet, said second end of said top sheet extending across said upper surface of said mattress and across said bottom sheet adjacent to said second end of said mattress generally parallel to said second end of said bottom sheet free from connection thereto, said top sheet extending across said upper surface of said mattress over said bottom sheet and downward from said upper surface of said mattress adjacent to said second edge of said mattress past said lower surface of said mattress such that said second edge of said top sheet extends generally parallel to said second edge of said bottom sheet free from connection thereto.

15. The connected bed sheet assembly of claim 14, further comprising a first elastic member extending along and mutually interconnected with said first edges of said bottom sheet and said top sheet; and a second elastic member extending along and interconnected to said second edge of said bottom sheet.

16. The connected bed sheet assembly of claim 15, wherein said first elastic member further extends along and is mutually connected with a portion of said connected first ends of said bottom sheet and top sheet and with a portion of said second end of said bottom sheet, and wherein said second elastic member further extends along and is mutually connected with a portion of said connected first ends of said bottom sheet and said top sheet and with a portion of said second end of said bottom sheet.

17. The connected bed sheet assembly of claim 14, wherein said second edge of said top sheet is connected to said second edge of said bottom sheet through a minor portion of the length of said second edge of said top sheet from said first end there of toward said second end thereof.

18. The connected bed sheet assembly of claim 14, wherein said bottom sheet and said top sheet are constructed of a flexible fabric material.

19. The connected bed sheet assembly of claim 18, wherein the interconnections between said first ends of said bottom sheet and said top sheet and between said first edges of said bottom sheet and said top sheet are formed by stitching.

* * * * *